US008082617B2

(12) United States Patent
Wichmann et al.

(10) Patent No.: US 8,082,617 B2
(45) Date of Patent: Dec. 27, 2011

(54) AUTOMATIC SWIMMING POOL CLEANERS

(75) Inventors: Jeffrey A. Wichmann, San Diego, CA (US); Richard A. Varga, San Marcos, CA (US)

(73) Assignee: Zodiac Pool Systems, Inc., Moorpark, CA (US)

( * ) Notice: Subject to any disclaimer, the term of this patent is extended or adjusted under 35 U.S.C. 154(b) by 1589 days.

(21) Appl. No.: 11/224,773

(22) Filed: Sep. 13, 2005

(65) Prior Publication Data

US 2007/0056124 A1 Mar. 15, 2007

(51) Int. Cl.
*E04H 4/16* (2006.01)

(52) U.S. Cl. ..... 15/1.7; 15/246

(58) Field of Classification Search ..... 15/1.7, 15/246, 230.14, 230.16, 230, 230.1, 98, 29; 210/167.16; D32/25
See application file for complete search history.

(56) References Cited

U.S. PATENT DOCUMENTS

| | | | | |
|---|---|---|---|---|
| 2,893,037 | A * | 7/1959 | Strong | 15/180 |
| 3,936,899 | A | 2/1976 | Henkin et al. | |
| 3,972,339 | A | 8/1976 | Henkin et al. | |
| 4,351,077 | A | 9/1982 | Hofmann | |
| 4,530,125 | A | 7/1985 | Hofmann | |
| 4,618,420 | A | 10/1986 | Alanis | |
| 5,418,995 | A | 5/1995 | Rice et al. | |
| 5,421,054 | A | 6/1995 | Dawson et al. | |
| 5,465,443 | A | 11/1995 | Rice et al. | |
| 5,617,606 | A * | 4/1997 | Scott et al. | 15/246 |
| 5,802,653 | A | 9/1998 | Roumagnac | |
| 5,930,856 | A | 8/1999 | Van Der Meyden | |
| 6,094,764 | A | 8/2000 | Veloskey et al. | |
| 6,112,354 | A | 9/2000 | Stoltz et al. | |
| 6,241,899 | B1 | 6/2001 | Ramos | |
| 6,631,533 | B2 * | 10/2003 | Stahle et al. | 15/1.7 |
| 6,706,175 | B1 | 3/2004 | Rief | |
| 2002/0116772 | A1 * | 8/2002 | Phillipson et al. | 15/1.7 |
| 2005/0029177 | A1 | 2/2005 | Peterson | |

FOREIGN PATENT DOCUMENTS

EP 0543387 * 5/1993

* cited by examiner

*Primary Examiner* — Laura C Guidotti
(74) *Attorney, Agent, or Firm* — Dean W. Russell; Kilpatrick Townsend & Stockton LLP

(57) ABSTRACT

Automatic swimming pool cleaners are detailed. The cleaners may employ filter bags with novel stiffeners to help retain their optimal debris-collection shapes in use. They additionally may include bags made of material having sanitizing properties or additives, allowing water sanitization to occur as water flows through the bags themselves. Cleaners described herein further may include discs having generally radial but non-linear slits to facilitate navigation in particular conditions and fix buoyant material within a collar by which a bag is attached to a body of the device.

8 Claims, 8 Drawing Sheets

SECTION *A-A*

SECTION C-C

AUTOMATIC SWIMMING POOL CLEANERS

FIELD OF THE INVENTION

This invention relates to automatic swimming pool cleaners including (but not limited to) pressure-side cleaners having any or all of innovative discs and bags, novel placement of flotation material, and water-sanitization capabilities.

BACKGROUND OF THE INVENTION

U.S. Pat. No. 4,351,077 to Hofmann illustrates one of numerous existing designs for automatic swimming pool cleaners. Cleaners such as that depicted in the Hofmann patent are configured for attachment, via a hose, to the inlet of an associated pump. They hence are commonly referred to as "suction-side" cleaners, as the inlet forms the "suction" side of the pump. When the pump operates, debris-laden water is drawn from the pool through the cleaner body (head) and hose to, typically, a filtration mechanism remote from the cleaner itself.

Many traditional suction-side cleaners include internal valves and external discs to effect movement of the cleaners within pools. As described in the Hoffman patent, for example, an internal flapper valve oscillates between two terminal positions within the fluid-flow path of the cleaner. The oscillation results, in use, to an intermittent cut-off flow through the head as the valve oscillates between its terminal positions and this in turn causes pulsations which result in longitudinal contractions and relaxations in the longitudinally resilient suction [hose] . . . . In consequence of these contractions and relaxations and a simultaneous reduction and increase of the force applied to hold the disc against the surface to be cleaned, a step by step movement of the head takes place over the surface to be cleaned.

See Hofmann, col. 3,11. 41-52 (numeral omitted).

Multiple discs have been designed to enhance cleaner performance in pools. U.S. Pat. No. 5,421,054 to Dawson, et al. and U.S. Pat. No. 5,418,995 to Rice, et al., illustrate annular discs having peripheral, upwardly-extending fins and generally circumferential slots, respectively. U.S. Pat. No. 4,530,125 to Hofmann details an annular disc with four equally-spaced, linear slits extending radially inward from the periphery toward the central aperture. U.S. Pat. No. 5,465,443 to Rice, et al. depicts yet other suction-side cleaner discs, including one having a series of generally radial, linear slits present solely in the rear section of the disc. This disc additionally accepts a cap similarly comprising rearwardly-positioned radial slits.

"Pressure-side" cleaners, by contrast, conventionally do not utilize annular discs to facilitate their movement within pools. These cleaners, which are connected (again typically via hoses) to outlets of associated pumps, instead use pressurized water flow to turn turbines, provide jet streams, or otherwise to effect their movement. One example of such a pressure-side cleaner in which a turbine drives wheels is shown in U.S. Pat. No. 3,936,899 to Henkin, et al.

Additionally unlike suction-side cleaners, pressure-side cleaners typically employ filtration mechanisms either within or proximate to their bodies. U.S. Pat. No. 5,930,856 to Van der Meyden, et al. illustrates a pressure-side cleaner with an internal screen-type filter for retaining debris, while the Henkin patent details such a cleaner with a filter in the form of a bag connected to the body. The Henkin patent further illustrates a float positioned externally of the body of the cleaner.

U.S. Pat. No. 5,802,653 to Roumagnac, finally, discloses a pressure-side cleaner incorporating a disc. The disc is indicated solely as being a "flange" or "flexible skirt," however, without indication of its shape or structure. The Roumagnac patent additionally does not disclose including a float as part of a cleaning device, nor does it identify any stiffener or other support for its external debris receptacle.

Thus, although many versions of automatic pool cleaners have been designed, no cleaner currently includes a disc with generally radial non-linear slits. Likewise, no pressure-side cleaner incorporates a float into an interface between a filter bag and the body. Few stiffeners for bags presently exist, and, to applicants' knowledge, no current cleaner is adapted to sanitize water flowing through a filter bag attached to the cleaner. Nevertheless, the disclosure of each of the Hofmann '077 and '125 patents, the Dawson patent, the Rice '995 and '443 patents, the Henkin patent, the Van der Meyden patent, and the Roumagnac patent is hereby incorporated herein in its entirety by this reference.

SUMMARY OF THE INVENTION

The present invention improves existing pool cleaner technology by developing features omitted from prior cleaner designs. Certain presently-preferred versions of the cleaners employ filter bags with novel stiffeners to help retain their optimal debris-collection shapes in use. These or other versions additionally may include bags made of material having sanitizing properties or additives, allowing water sanitization to occur as water flows through the bags themselves. Cleaners of the present invention additionally may include discs having generally radial but non-linear slits to facilitate navigation in particular conditions.

They further may fix the location of buoyant material within the cleaners relative to the positioning of the bags and the bodies. Indeed, in some versions, the buoyant material, typically foam, is placed within a collar by which a bag is attached to a body of the device. If the position of the buoyant material were not fixed in this manner, the material could move as the cleaner orientation changes, thereby changing the buoyancy characteristics of the cleaner as it moves within a pool (and particularly when it attempts to climb pool walls).

It thus is an optional, non-exclusive object of the present invention to provide innovative automatic swimming pool cleaners.

It is an additional optional, non-exclusive object of the present invention to provide pressure-side cleaners with novel filter bags.

It is another optional, non-exclusive object of the present invention to provide pressure-side cleaners employing annular discs to facilitate cleaner movement within pools.

It is, moreover, an optional, non-exclusive object of the present invention to provide cleaner discs having generally radial but non-linear slits.

It is a further optional, non-exclusive object of the present invention to provide cleaners with filter bags having novel stiffeners.

It is also an optional, non-exclusive object of the present invention to provide cleaners whose filter bags are made of, or include as additives, water-sanitizing material.

It is yet another optional, non-exclusive object of the present invention to provide cleaners including buoyant material whose position is fixed relative to certain other components of the cleaners.

It is an additional optional, non-exclusive object of the present invention to provide cleaners in which buoyant foam is incorporated into collars by which bags are attached to cleaner bodies.

Other objects, features, and advantages of the present invention will be apparent to those skilled in the relevant fields with reference to the remaining text and drawings of this application.

DETAILED DESCRIPTION

Figure 1:
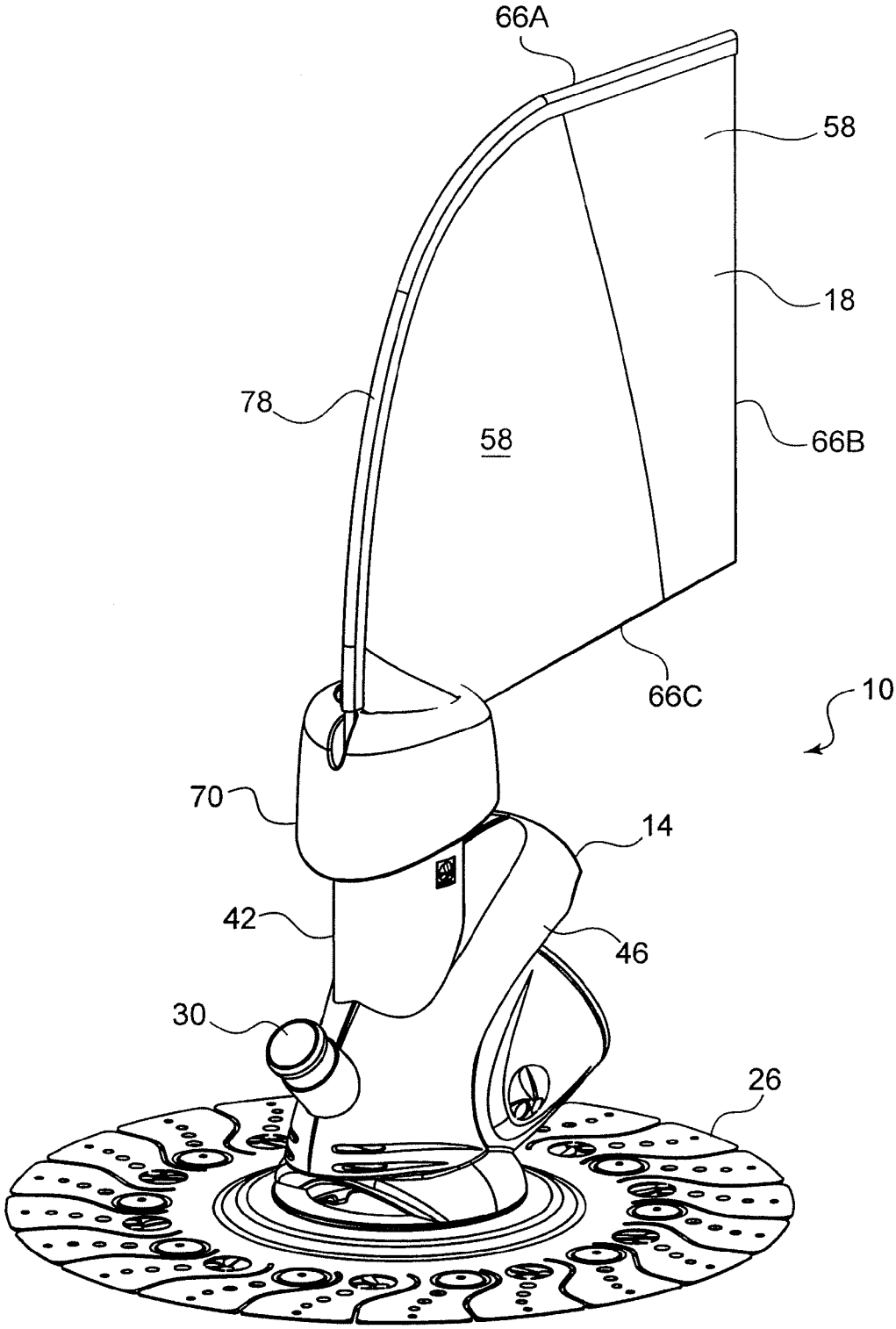
FIG. 1 is a perspective view of an exemplary automatic swimming pool cleaner of the present invention.
Figure 2:
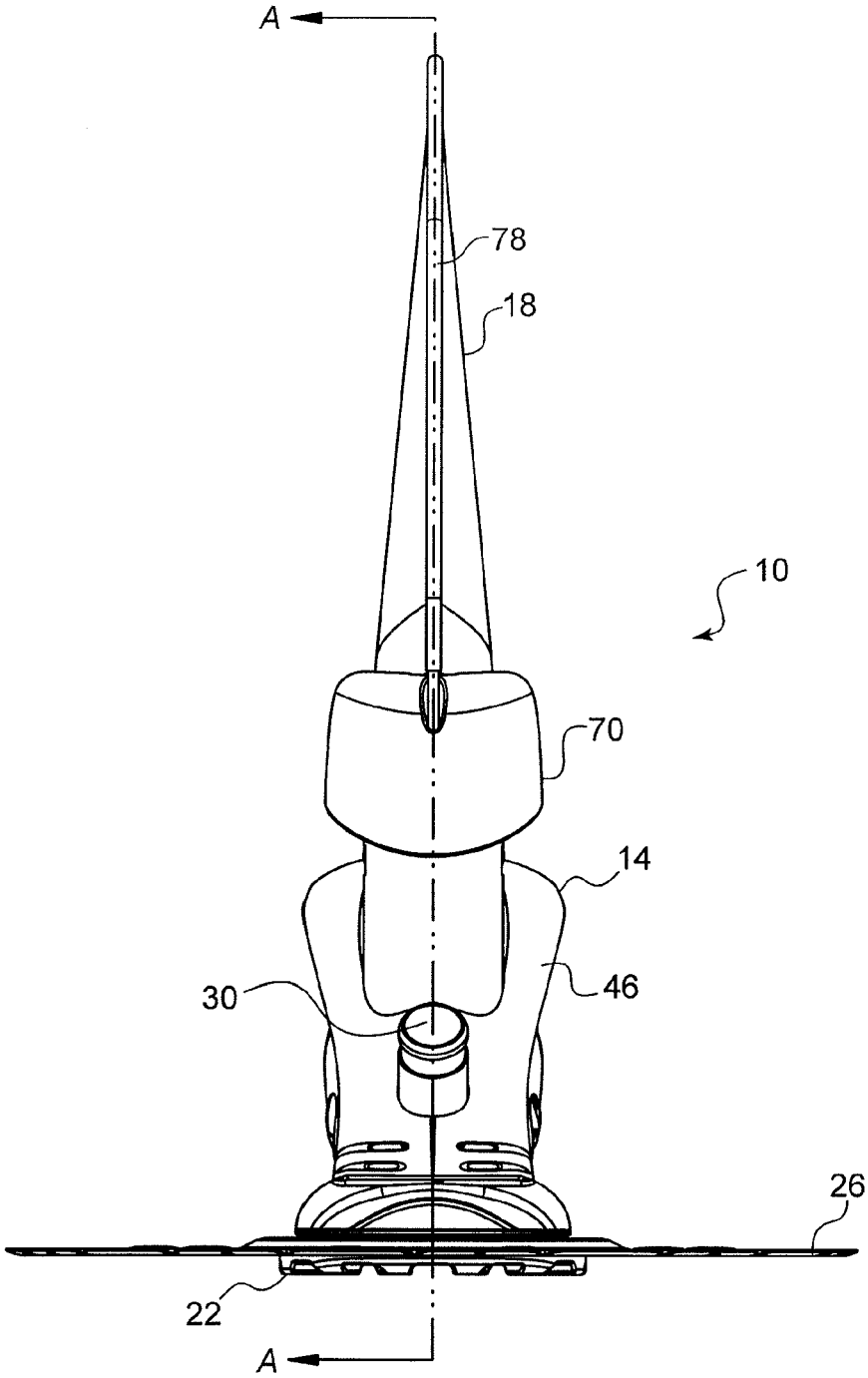
FIG. 2 is an elevational view of the cleaner of FIG. 1.

Detailed in FIGS. 1-4 is an exemplary automatic swimming pool cleaner 10 of the present invention. Included as part of cleaner 10 may be any or all of head or body 14, filter 18, footpad 22, and disc 26. Cleaner 10 is designed beneficially for use submerged within a swimming pool, with pressurized water entering the pool being used for motive and debris-collection purposes. Cleaner 10 hence preferably is a pressure-side cleaner, although many aspects of the invention may be utilized for other cleaners or devices as appropriate or desired.

Comprising body 14 may be first inlet 30, second inlet 34, and first outlet 38. First inlet 30 advantageously connects to a pump discharge opening, typically (although not necessarily) in the side wall of a pool. Such connection may occur directly or indirectly and using a hose, pipe, or other suitable means. Accordingly, first inlet 30 is adapted to receive pressurized water having exited a pump of a water-circulation system associated with the pool.

Second inlet 34, by contrast, receives debris-laden water directly from the interior of the pool. In the version of cleaner 10 shown especially in FIG. 3, for example, the debris-laden water then travels (nominally) upward through (nominally) vertical tube 42 to first outlet 38. From first outlet 38, the debris-laden water enters filter 18 to remove most solid matter therefrom.

Additionally included as part of body 14 may be shell 46, second outlet 50, and a multi-sleeve structure 54. Shell 46, shown in FIG. 4 as halves 46A and 46B that may be fitted together, need not necessarily be present in body 14. If present, however, shell 46 beneficially may be used to seat structure 54 relative to second outlet 50.

Second outlet 50 and structure 54 may function cooperatively as described in, for example, the Roumagnac patent. As indicated therein, sleeves of structure 54 may rotate, causing certain openings to align periodically, thereby temporarily altering a path of the pressurized water flowing within cleaner 10. Each alteration causes an elastic pipe or hose connected to first inlet 30 to contract, effectively pulling cleaner 10 in the direction of the contraction in a step-wise fashion.

Again consistent with the Roumagnac patent, most pressurized water entering cleaner 10 via first inlet 30 is expelled through an internal nozzle upward into tube 42. Venturi principles dictate that this jet of water will tend to evacuate the surrounding area, sucking debris-laden pool water into tube 42 through second inlet 34. The evacuation additionally tends to force disc 26 against the surface of the pool to be cleaned.

As shown in FIGS. 1-5, filter 18 preferably is in the form of a bag 58 defined by mouth 62 and sealed edges 66A-C. If present as bag 58, filter 18 advantageously is a mesh, with spacing such that water may pass through the mesh while most entrained particulate matter may not. Those skilled in the relevant art will, however, recognize that filter 18 need not necessarily be in the form of a bag or, if a bag, need not necessarily be configured or function identically to bag 58.

Connecting bag 58 to tube 42 may be collar 70. Collar 70 may attach to body 14 in any manner permitting fluid communication between tube 42 and bag 58. Preferably, however, collar 70 is snap-fitted directly onto tube 42 of body 14 in the vicinity of first outlet 38. Collar 70 additionally receives mouth 62 of bag 58, with clip 74 or any other suitable fastener fixing bag 58 in place.

Positioned along leading edge 66A of bag 58 is stiffener 78. Stiffener 78 preferably is configured as an elongated, curved rod as shown in FIGS. 1-5. If so configured, end 82 is the (nominally) forwardmost portion of stiffener 78, with the stiffener 78 extending rearwardly to end 86. The result is a lower profile for bag 58 than if stiffener 78 were linear. Stiffener 78 preferably is sewn into or otherwise attached within bag 58 along edge 66A, although it could alternatively be attached to the exterior of bag 58 or at a location other than edge 66A.

Whether or not curved, when located along edge 66A, stiffener 78 nevertheless functions much like a mast during operation of cleaner 10. Accordingly, bag 58 functions similar to a sail when cleaner 10 is in use. Cooperatively, stiffener 78 and water flow into mouth 62 serve to minimize possibility of collapse of bag 58, thereby reducing likelihood of bag 58 being clogged prematurely. Consequently, bag 58 need not be clipped to any input hose or pipe to prevent its collapse.

As noted above, the mesh design of bag 58 allows mechanical filtration of water passing through the bag. If desired, however, bag 58 additionally may chemically filter water passing therethrough. Indeed, bag 58 may be formed of anti-microbial material or have anti-microbial material added thereto, one example of which is provided under the brand name MICROBAN® anti-microbial material available from Microban International, Ltd. Water contacting the anti-microbial material may be sanitized thereby as it passes through bag 58 back into a pool.

Figure 3:
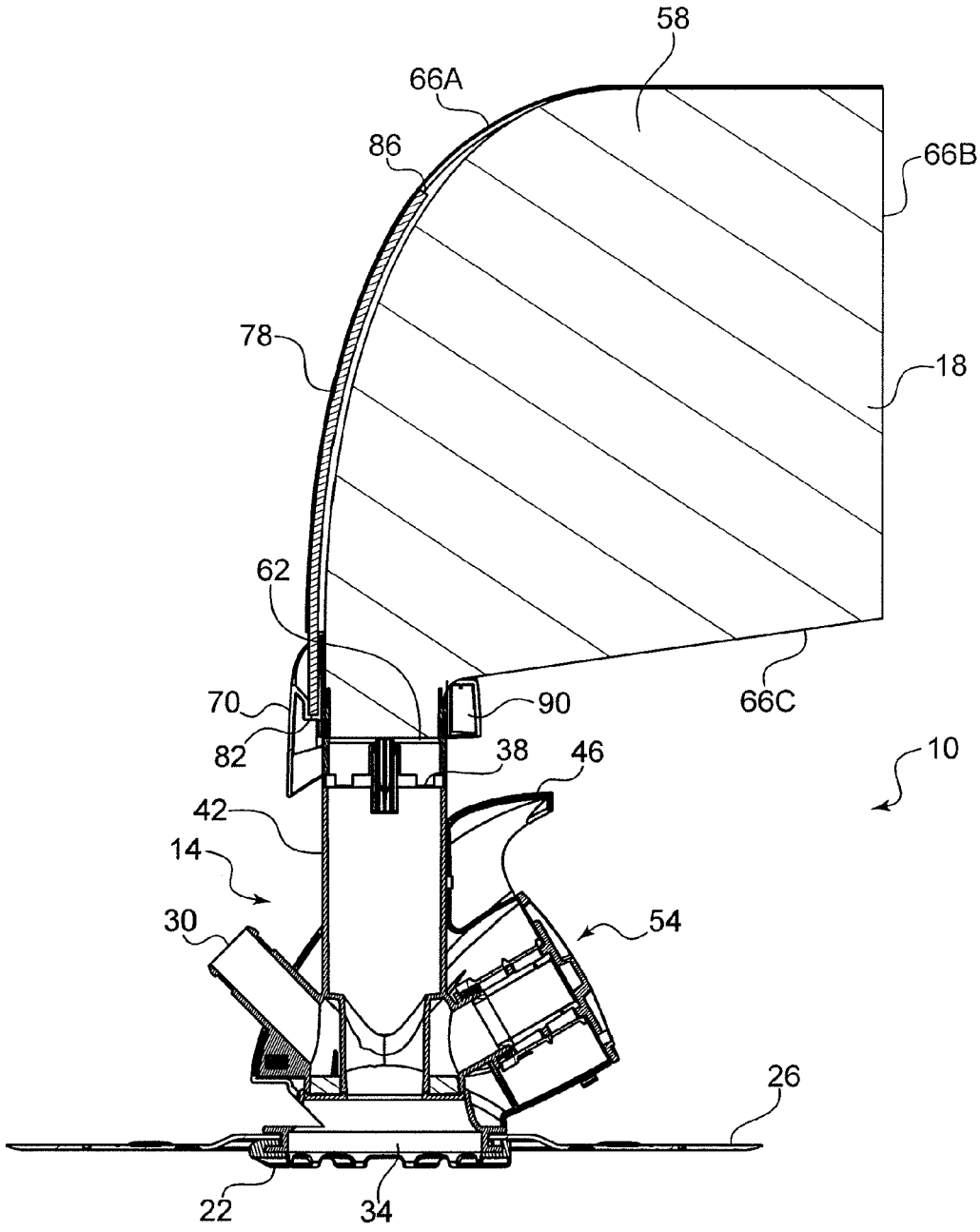
FIG. 3 is a cross-sectional view of the cleaner of FIG. 1 taken along line A-A of FIG. 2.
Figure 4:
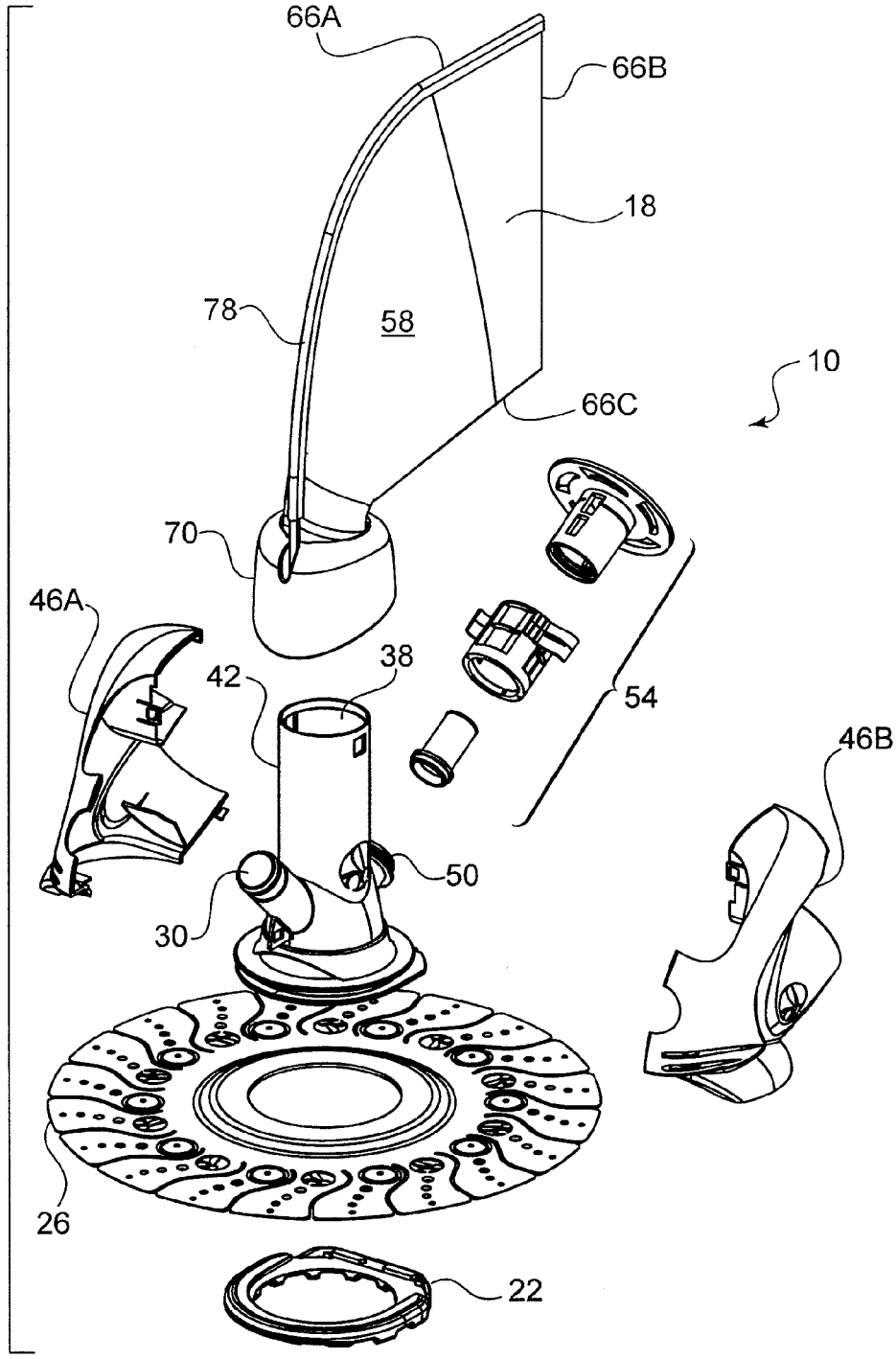
FIG. 4 is an exploded view of the cleaner of FIG. 1.
Figure 5:
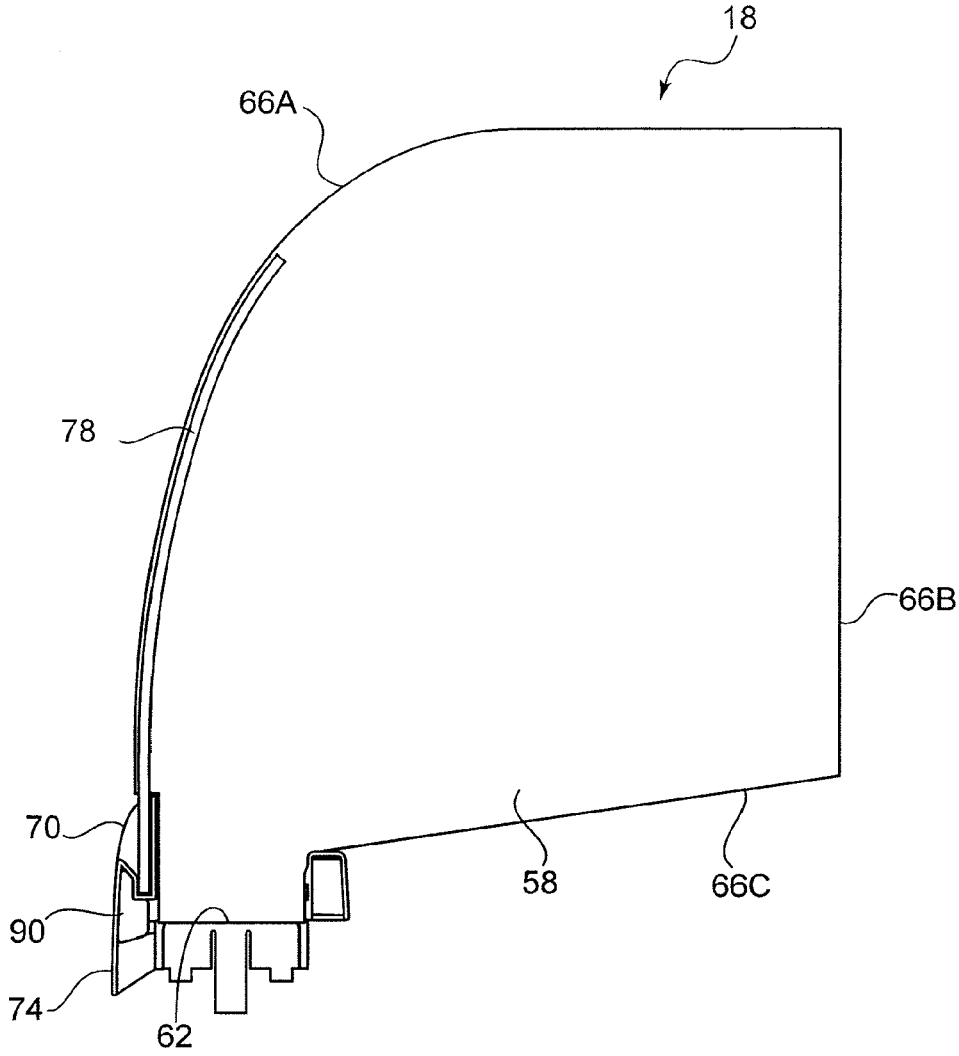
FIG. 5 is a partially cut-away view of certain components (including a bag, stiffener, and buoyant material) of the cleaner of FIG. 1.
Figure 6:
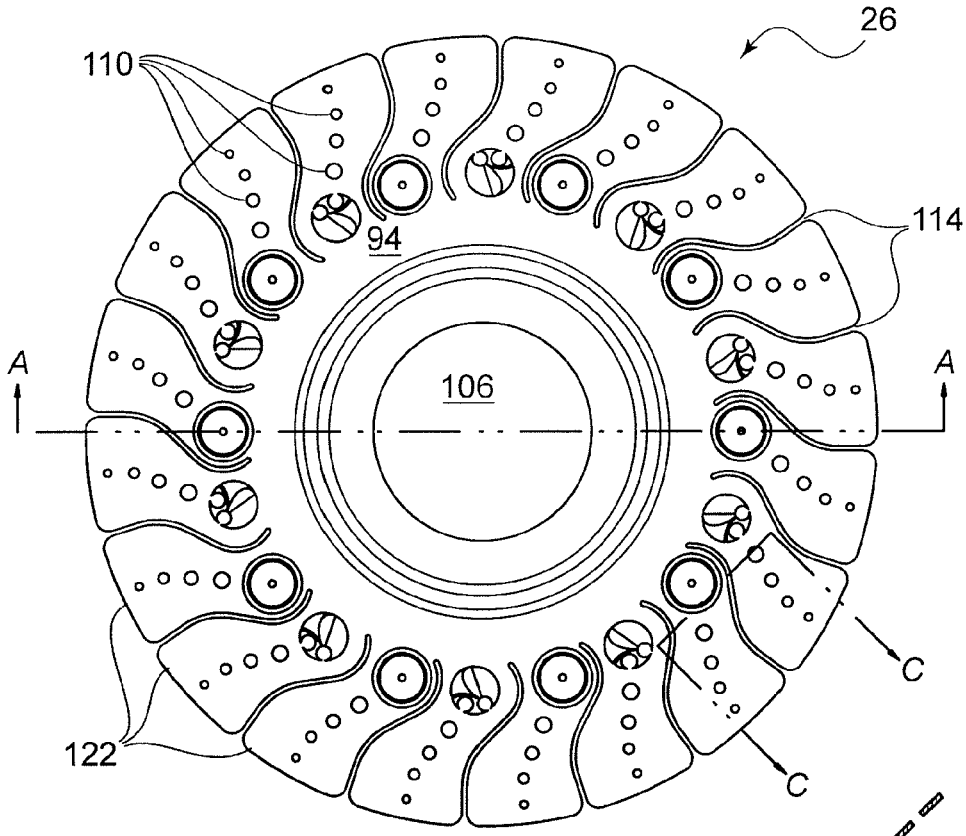
FIG. 6 is a top plan view of a disc of the cleaner of FIG. 1.
Figure 8:
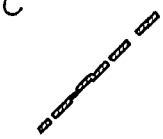
FIG. 8 is a cross-sectional view of the disc of FIG. 6 taken along line C-C of that figure.
Figure 7:
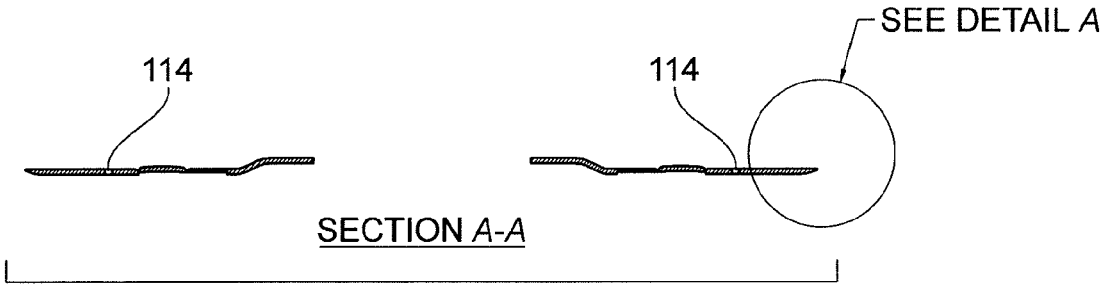
FIG. 7 is a cross-sectional view of the disc of FIG. 6 taken along line A-A of that figure.
Figure 9:
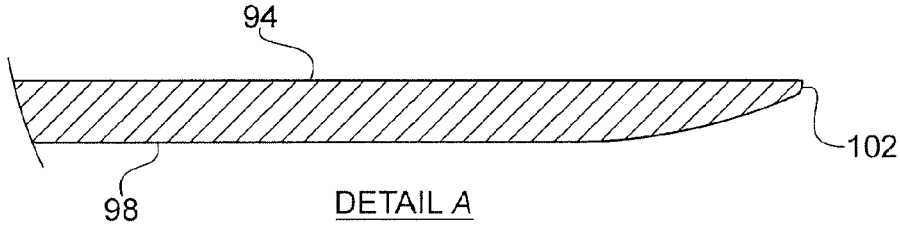
FIG. 9 is a detail view of a portion of the disc shown in FIG. 7.

Positioned within collar 70 is buoyant (flotation) material 90, depicted in FIGS. 3-5 as an annular piece of foam. Material 90 need not be so shaped or positioned, however, and may comprise buoyant elements other than foam if desired. Preferably, however, material 90 is fixed within collar 70, so that its position relative to body 14 does not change even if cleaner 10 changes its orientation within a pool. Such position fixing is especially advantageous when cleaner 10 climbs a side wall of a pool; in particular, as compared to cleaners in which flotation material is positioned within the filter bag (and thus can move as the bag moves or, because of its buoyancy, can cause the bag to move), cleaner 10 reduces the likelihood that bag 58 will undesirably tend to float to the surface of the pool as the cleaner 10 climbs a wall.

FIGS. 6-11 illustrate aspects of disc 26 of the present invention. Disc 26 includes upper surface 94 and underside 98. As depicted, disc 26 is generally annular, with generally circular, chamfered periphery 102 and defining circular central aperture 106. Although applicants presently prefer such annular shape for disc 26, it need not necessarily be so shaped. Disc 26 is adapted to be received by body 14 (see, e.g., FIG. 3) and to abut footpad 22. (Alternatively, disc 26 may be received by the footpad 22.)

Incorporated into disc 26 are series of through holes 110 and multiple curved slits 114. Holes 110 function similar to the immediate apertures of the Rice '995 patent. Rather than being sized identically, however, holes 110 preferably are of differing diameters. Indeed, most preferably holes 110 increase in size from periphery 102 toward central aperture 106. Holes 110 need not necessarily be configured in this manner, however, nor need they be circular in shape.

Slits 114 divide peripheral portion 118 of disc 26 into multiple fingers 122 containing through holes 110. Unlike the rear-section-only slits of the Rice '443 patent, slits 114 may be present throughout the circumference of disc 26. Consequently, even if disc 26 rotates some in use, no misorientation of fingers 122 will occur. Likewise, if suction force is lost for any particular finger 122 (as, for example, when such finger 122 encounters an object protruding outward from the surface to be cleaned), suction force for most or all remaining fingers 122 should be unaffected.

Significantly, moreover, slits 114 preferably are not linear but rather are curved. By curving slits 114, the area of suction break possible over linear slits for the same radial distance inward from periphery 102 is increased. Curving slits 114 additionally helps a given finger 122 to resist movement that otherwise might cause it laterally to overlap an adjacent finger 122.

Figure 10:
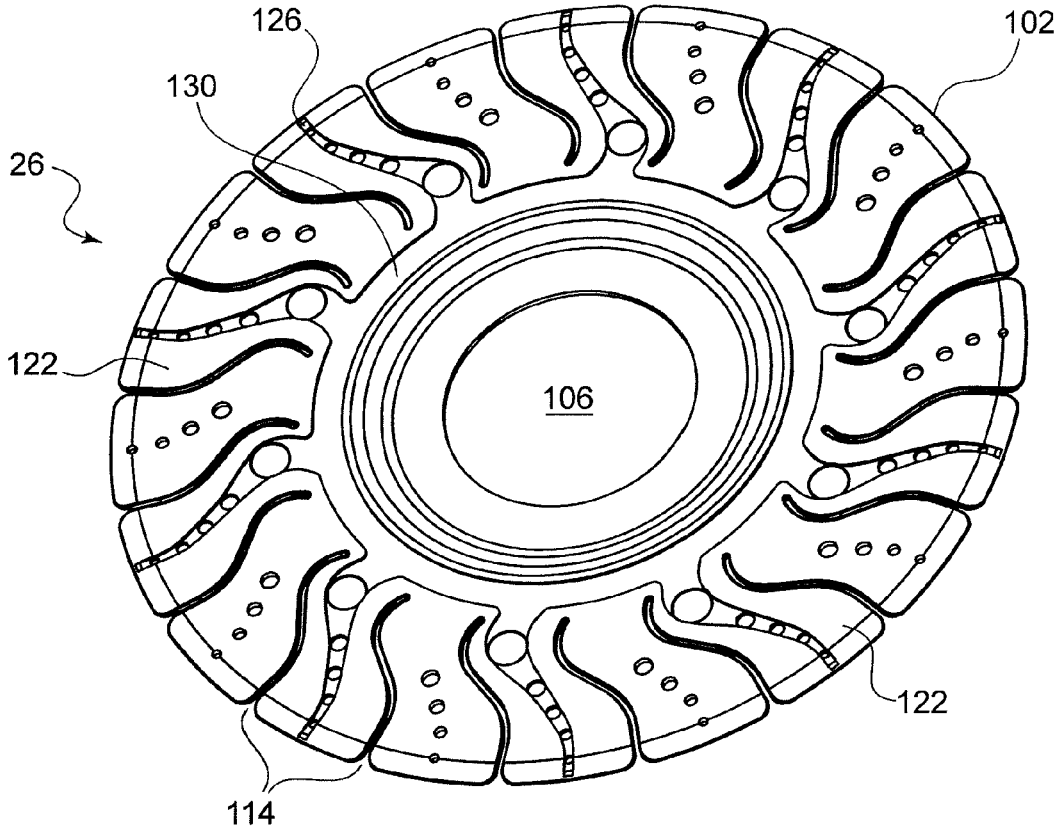
FIG. 10 is a perspective view of the underside of the disc of FIG. 6.
Figure 11:
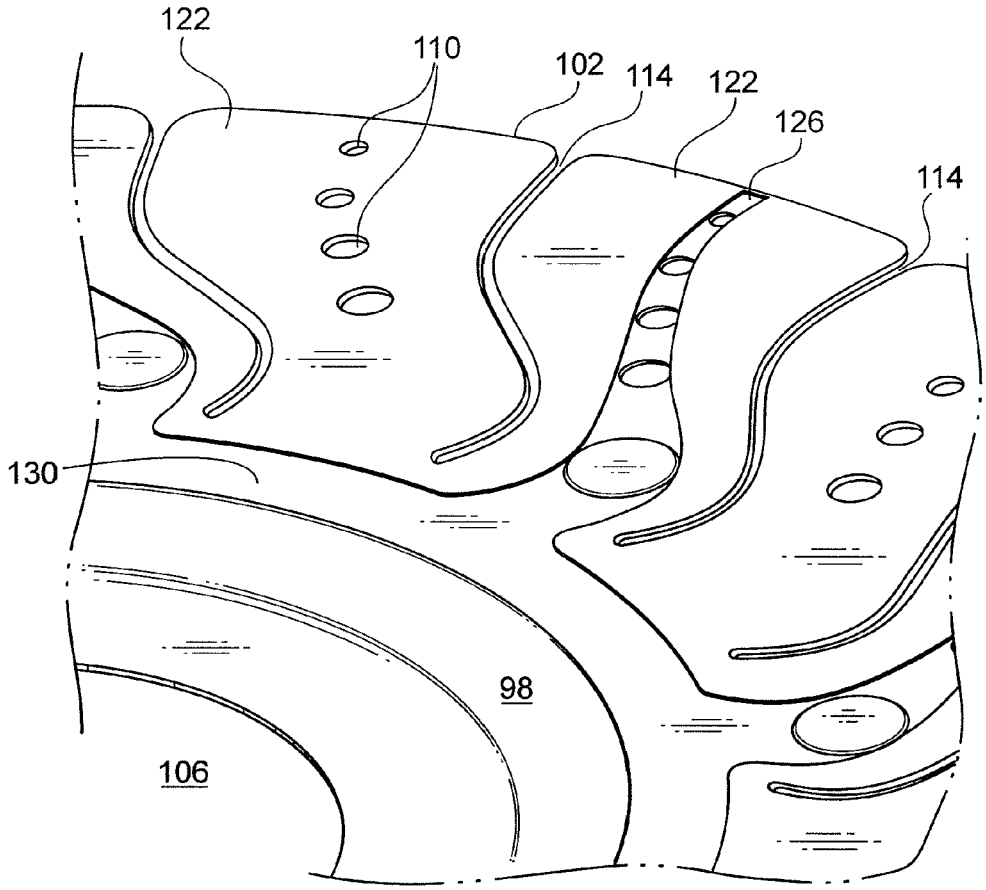
FIG. 11 is a detail view of a portion of the underside of the disc of FIG. 6 showing, as darker areas, channels existing in the underside of the disc.

Depicted especially in FIGS. 10-11 is underside 98 of disc 26. As shown in these figures, underside 98 additionally may include generally radial, curved channels 126, each communicating with annular channel 130 circumscribing central aperture 102. Channels 126 need not necessarily be curved, however, nor, if curved, need they necessarily be curved similar to the curvature of slits 114. Likewise, channel 130 need not necessarily be annular.

Moreover, although ten channels 126 are detailed in FIG. 10, fewer or greater numbers of channels 126 may be present instead. Preferably, however, channels 126 and 130 are formed as shown in FIGS. 10-11, with channels 126 alternating in fingers 122. Also advantageously, holes 110 are positioned so that at least some sets communicate with channels 126. Together, holes 110, channels 126, and channel 130 help manage suction pressure of disc 26 against a surface to be cleaned and enhance water flow into second inlet 34 of body 14.

The foregoing is provided for purposes of illustrating, explaining, and describing exemplary embodiments and certain benefits of the present invention. Modifications and adaptations to the illustrated and described embodiments will be apparent to those skilled in the relevant art and may be made without departing from the scope or spirit of the invention.

What is claimed is:

1. A disc having a thickness and configured for use as part of an automatic swimming pool cleaner having a footpad, comprising:

a. an upper surface;
b. an underside;
c. a periphery;
d. means, comprising a central aperture, for receiving the footpad of the automatic swimming pool cleaner in use;
e. a plurality of non-linear slits forming discontinuities in the periphery and extending from the periphery toward the central aperture; and
f. at least one non-linear channel (i) formed in the underside, (ii) having a depth less than the thickness, and (iii) extending from the periphery toward the central aperture.

2. A disc configured for use as part of an automatic swimming pool cleaner having a footpad, comprising:

a. an upper surface;
b. an underside;
c. a periphery;
d. means, comprising a central aperture, for receiving the footpad; and
e. a progression of adjacent through holes extending from the periphery toward the central aperture, with (i) a first hole of the progression of through holes proximate the periphery being smaller in size than an adjacent second hole of the progression of through holes more remote from the periphery and (ii) the second hole of the progression of through holes being smaller in size than an adjacent third hole of the progression of through holes more remote from the periphery.

3. A disc according to claim 2 further comprising a peripheral portion and slits dividing the peripheral portion into multiple fingers and in which the progression of adjacent through holes is contained by a first finger of the multiple fingers.

4. A disc according to claim 3 further comprising a second progression of adjacent through holes contained by a second finger of the multiple fingers.

5. A disc according to claim 4 in which the slits are non-linear.

6. A disc configured for use as part of an automatic swimming pool cleaner having a body, the disc comprising:

a. an upper surface;
b. an underside;
c. a periphery;
d. means for direct or indirect connection to the body of the automatic swimming pool cleaner in use; and
e. a plurality of slits forming discontinuities in the periphery and extending from the periphery toward the connection means, each of the plurality of slits being curved so as to define a longitudinal centerline that is wholly non-linear.

7. A disc according to claim 6 having a thickness, further comprising at least one non-linear channel (a) formed in the underside, (b) having a depth less than the thickness, and (c) extending from the periphery toward the central aperture.

8. A disc according to claim 6 in which the periphery is generally circular.

* * * * *